US012410549B2

(12) United States Patent
Lim et al.

(10) Patent No.: US 12,410,549 B2
(45) Date of Patent: Sep. 9, 2025

(54) DOOR LOCK DEVICE

(71) Applicant: DUAL POWER ELECTRONICS CO., LTD, Jeongeup-si (KR)

(72) Inventors: Jang-Joo Lim, Seoul (KR); Sang-Won Suh, Jeongeup-si (KR); Jung-Gil Lee, Jeongeup-si (KR); Hee-Chang Kim, Jeongeup-si (KR)

(73) Assignee: DUAL POWER ELECTRONICS CO., LTD, Jeongeup-si (KR)

( * ) Notice: Subject to any disclaimer, the term of this patent is extended or adjusted under 35 U.S.C. 154(b) by 154 days.

(21) Appl. No.: 17/938,503

(22) Filed: Oct. 6, 2022

(65) Prior Publication Data

US 2023/0024919 A1 Jan. 26, 2023

Related U.S. Application Data

(63) Continuation of application No. PCT/KR2021/002749, filed on Mar. 5, 2021.

(30) Foreign Application Priority Data

Jun. 5, 2020 (KR) ..... 10-2020-0068191

(51) Int. Cl.
*D06F 39/14* (2006.01)
*D06F 37/42* (2006.01)

(52) U.S. Cl.
CPC ..... *D06F 39/14* (2013.01); *D06F 37/42* (2013.01)

(58) Field of Classification Search
CPC ..... D06F 39/14; D06F 37/42; D06F 34/20; A47L 15/4259; E05B 47/0603
See application file for complete search history.

(56) References Cited

U.S. PATENT DOCUMENTS

2018/0008120 A1 1/2018 Dirnberger et al.
2021/0363801 A1* 11/2021 Wang ..... D06F 39/14

FOREIGN PATENT DOCUMENTS

CN 104233712 A * 12/2014 ..... D06F 37/28
CN 107034635 A * 8/2017
(Continued)

OTHER PUBLICATIONS

Computer Generated Translation for CN 107245845, Generated on Jun. 26, 2024, https://worldwide.espacenet.com/ (Year: 2024).*
(Continued)

*Primary Examiner* — Alyson M Merlino
(74) *Attorney, Agent, or Firm* — Studebaker Brackett PLLC

(57) ABSTRACT

The present disclosure relates to a door lock device including: a case; an opening/closing part to open/close a door according to the advancing and retreating of a hook connected to the door; a driving part for guiding the opening/closing operation of the opening/closing part through linear movement; and a connecting part for connecting the opening/closing part and the driving part. The opening/closing part includes: a locker coupled to or separated from the hook through a rotational motion when the hook advances and retreats; a locker support member that is hinge-coupled to the case, is coupled to the locker to support the rotation of the locker, and rotates in the advancing or retreating direction of the book during the rotational motion of the locker; and an elastic member positioned between the bottom surface of the case and the locker support member to press the locker support member in one direction.

4 Claims, 3 Drawing Sheets

(56) References Cited

FOREIGN PATENT DOCUMENTS

| | | | | | |
|---|---|---|---|---|---|
| CN | 107245845 | A | * | 10/2017 | ..... D06F 37/42 |
| CN | 108070990 | A | * | 5/2018 | |
| CN | 109339595 | A | * | 2/2019 | ..... E05B 15/00 |
| CN | 109469415 | A | * | 3/2019 | ..... E05B 15/00 |
| CN | 110984703 | B | * | 4/2021 | ..... D06F 37/42 |
| DE | 102006058322 | A1 | * | 6/2008 | ..... A47L 15/4259 |
| EP | 2278058 | A1 | | 1/2011 | |
| JP | 2013-194472 | A | | 9/2013 | |
| KR | 10-2005-0080784 | A | | 8/2005 | |
| KR | 10-2007-0089237 | A | | 8/2007 | |
| KR | 10-1052680 | B1 | | 7/2011 | |
| KR | 10-2012-0008689 | A | | 2/2012 | |
| KR | 20-2012-0004174 | U | | 6/2012 | |
| KR | 10-1667916 | B1 | | 10/2016 | |
| KR | 10-1915250 | B1 | | 11/2018 | |
| KR | 10-1959753 | B1 | | 7/2019 | |

OTHER PUBLICATIONS

Computer Generated Translation for DE 102006058322, Generated on Jun. 26, 2024, https://worldwide.espacenet.com/ (Year: 2024).*
Computer Generated Translation for CN 109339595, Generated on Mar. 26, 2025, https://worldwide.espacenet.com/ (Year: 2025).*
International Search Report issued in PCT/KR2021/002749; mailed Jun. 15, 2021.

* cited by examiner

DOOR LOCK DEVICE

CROSS-REFERENCE TO RELATED APPLICATIONS

The present application is a continuation of International Patent Application No. PCT/KR2021/002749, filed on Mar. 5, 2021, which is based upon and claims the benefit of priority to Korean Patent Application No. 10-2020-0068191 filed on Jun. 5, 2020. The disclosures of the above-listed applications are hereby incorporated by reference herein in their entirety.

TECHNICAL FIELD

The present invention relates to a door lock device for home appliances and more particularly, to a door lock device mounted to a washing machine, a dryer, and the like.

RELATED ART

In our daily lives, there are various home appliances. In particular, in the case of a washing machine, a dryer, a dishwasher, and a microwave oven that are used by inputting contents, a door is installed such that the input contents may be blocked from an outside and a locking device that opens and closes the door is an essential component of such home appliance.

Until recently, various technologies related to a door lock device have been developed. Representative inventions include Korean Patent Registration No. 10-1667916 (push and push door lock device), Korean Patent Registration No. 10-1915250 (manual door lock device), and the like.

The push and push door lock device describes a door lock device in which a door automatically opens without a user opening the door when an operation of a corresponding home appliance is terminated.

The push and push door lock device includes an unlocking button installed in a main body and configured to unlock a locker by releasing a restraining force of a fastening member by a sliding operation and a driving unit configured to selectively control a door holding operation, a door locking operation, and an automatic door opening operation by a rotational motion of a rotational shaft having a cam protrusion at one side. However, since a driving unit and a sensing member sense a locking operation or an unlocking operation of a locker by sensing a position of a cam protrusion, the above device has an issue in that the overall configuration and control are complex.

The manual door lock device describes a door lock device that may manually operate in a simple structure, which differs from the existing method that electronically operates by a solenoid.

However, the above manual door lock device adopts a manual control method that requires an action of a user, which may be slightly against the trend of convenience-oriented home appliances.

TECHNICAL OBJECT

An objective of the present invention is to provide a door lock device that may perform stable locking and unlocking with a simple configuration and few failures.

TECHNICAL SOLUTION

A door lock device for washing machine according to an example embodiment includes a case having an inner space; an opening/closing portion provided in the inner space and configured to open and close a door according to entry and retraction of a hook connected to the door; and a locking portion distinguished from the opening/closing portion and configured to form an independent anterior chamber and to lock or unlock the door. The opening/closing portion includes a locker configured to couple to or separate from the hook through a rotational motion in response to the entry and the retraction of the hook; and a cam spring configured to provide a rotational restoring force to the locker through connection to the locker, and the locking portion includes a solenoid configured to generate a linear thrust by an input electrical signal; a shaft configured to linearly move by the thrust generated from the solenoid; a slider configured to linearly move with the shaft through connection to the shaft; a fixed cam formed above the slider; a cam pin configured to control a linear motion of the slider through connection to one side of the fixed cam; an elastic member configured to provide a restoring force to the slider; a protrusion formed on a bottom surface of the slider; and a locker slide configured to protrude through the linear motion of the slider below the slider and to fasten the locker.

Here, the locker includes a fastening unit configured to insert into a coupling hole formed in the hook; and a locker fastening groove in which the locker slide is seated.

Here, the locker slide includes a moving track into which the protrusion inserts and is connected to the slider; and a locker seating groove configured to seat and fasten the locker at one end.

Here, an induction projection is formed on the slider and a curved electrode terminal is coupled in the induction projection.

The door lock device according to an example embodiment may further include an unlock slide formed on an outside of the case and configured to connect to the slider.

EFFECT OF INVENTION

A door lock device according to an example embodiment may have a simple structure, may have a relatively low manufacturing cost, and may secure durability.

Also, compared to the existing door lock device, the door lock device according to an example embodiment may be implemented with a compact size and may be advantageous in securing a space accordingly.

Also, a consumer may easily cope with the failure of a door lock device that may occur inadvertently.

DETAILED DESCRIPTION

Figure 1:
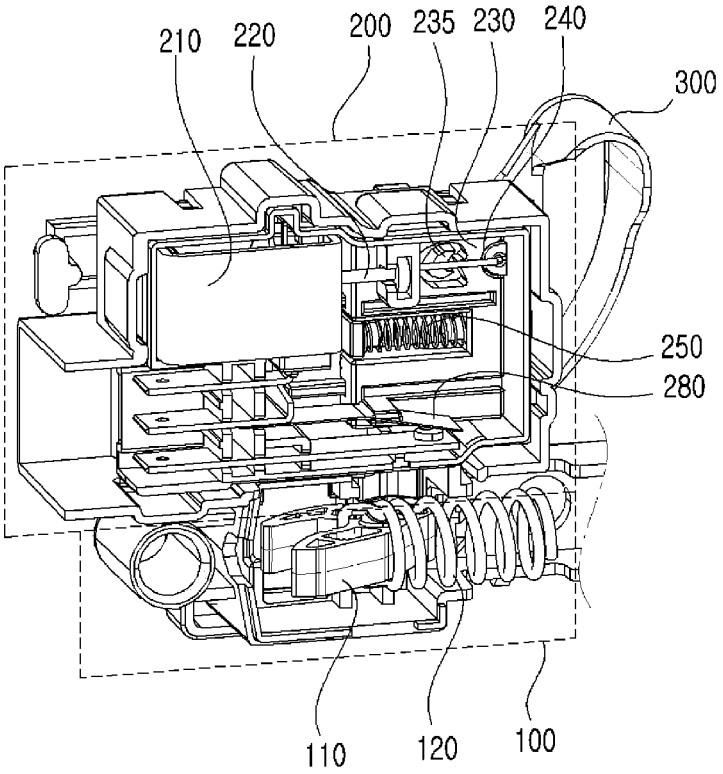
FIG. 1 is an internal cross-sectional view of a door lock device according to an example embodiment.

Specific structural or functional descriptions related to example embodiments according to the concept of the present invention set forth herein are simply provided to explain the example embodiments according to the concept of the present invention and the example embodiments according to the concept of the present invention may be implemented in various forms and are not limited to the example embodiments described herein.

Various modifications may be made to the example embodiments according to the concept of the present invention. Therefore, the example embodiments are illustrated in the drawings and are described in detail with reference to the detailed description. However, the example embodiments are not construed as being limited to specific forms and should be understood to include all changes, equivalents, and replacements within the idea and the technical scope of the present invention.

Although terms of "first," "second," and the like may be used to explain various components, the components are not limited to such terms. These terms are used only to distinguish one component from another component. For example, a first component may be referred to as a second component, or similarly, the second component may be referred to as the first component within the scope of the present invention.

When it is mentioned that one component is "connected" or "joined" to another component, it may be understood that the one component is directly connected or accessed to another component or that still other component is interposed between the two components. In addition, it should be noted that if it is described in the specification that one component is "directly connected" or "directly joined" to another component, still other component may not be present therebetween. Likewise, expressions, for example, "between" and "immediately between" and "adjacent to" and "immediately adjacent to" may also be construed as described in the foregoing.

The terminology used herein is for the purpose of describing particular example embodiments only and is not to be limiting of the example embodiments. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, components or a combination thereof, but do not preclude the presence or addition of one or more other features, integers, steps, operations, elements, components, and/or groups thereof.

Unless otherwise defined herein, all terms used herein including technical or scientific terms have the same meanings as those generally understood by one of ordinary skill in the art. Terms defined in dictionaries generally used should be construed to have meanings matching contextual meanings in the related art and are not to be construed as an ideal or excessively formal meaning unless otherwise defined herein.

Hereinafter, the example embodiments will be described in detail with reference to the accompanying drawings. However, the scope of the claims is not limited to or restricted by such example embodiments. Like reference numerals refer to like components throughout.

FIG. 1 is an internal cross-sectional view of a door lock device according to an example embodiment.

Figure 2:
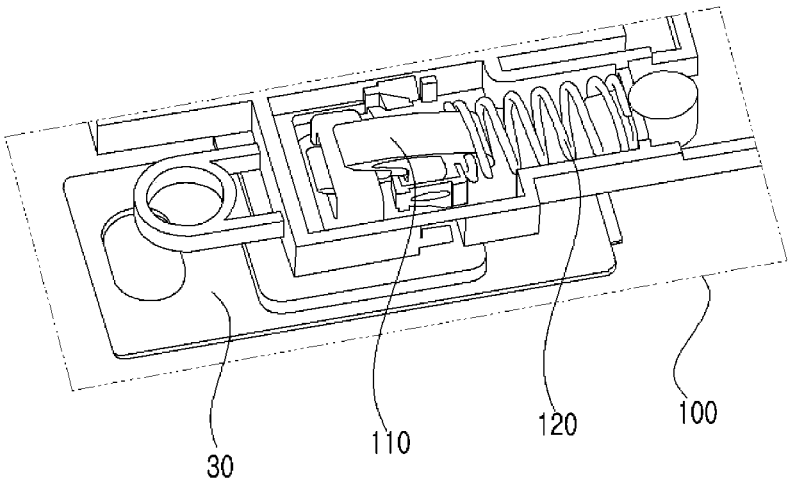
FIG. 2 is an internal perspective view of an opening/closing portion according to an example embodiment.

FIG. 2 is an internal perspective view of an opening/closing portion according to an example embodiment.

Figure 3:
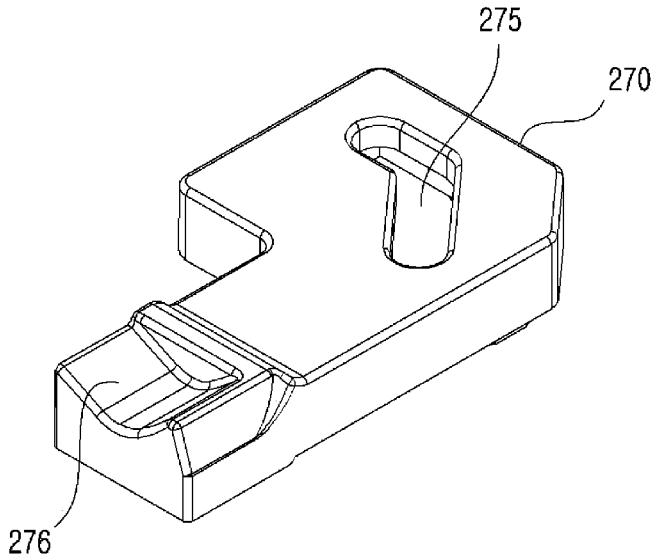
FIG. 3 is a perspective view of a locker slide according to an example embodiment.

FIG. 3 is a perspective view of a locker slide according to an example embodiment.

Figure 4:
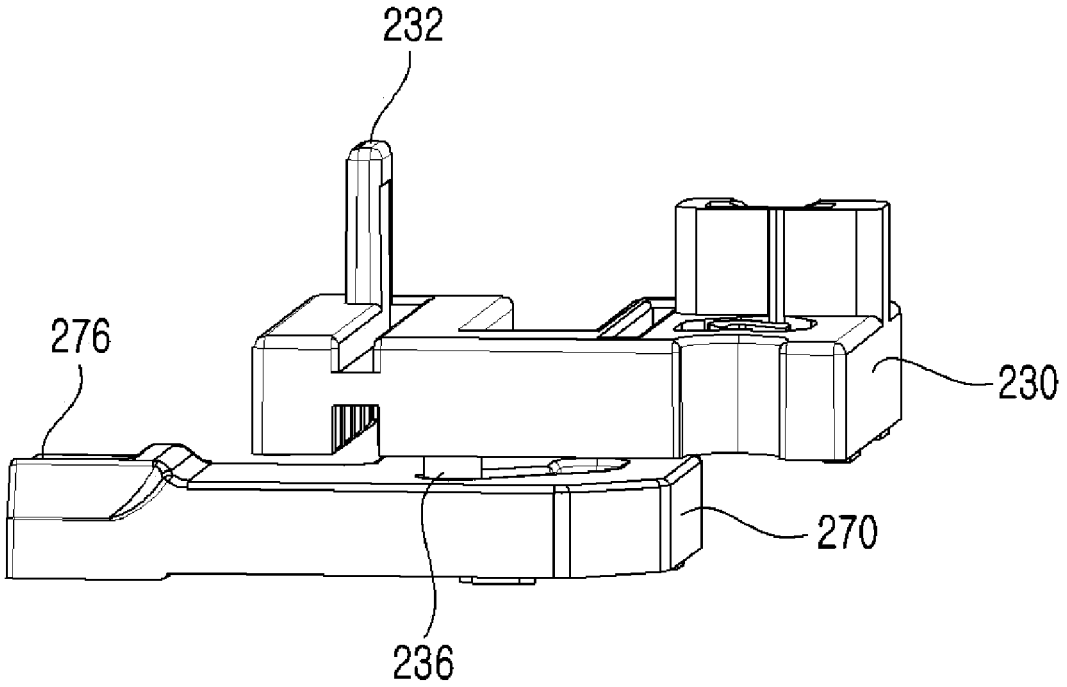
FIG. 4 is a perspective view of coupling between a slider and a locker slide according to an example embodiment.

FIG. 4 is a perspective view of coupling between a slider and a locker slide according to an example embodiment.

Figure 5:
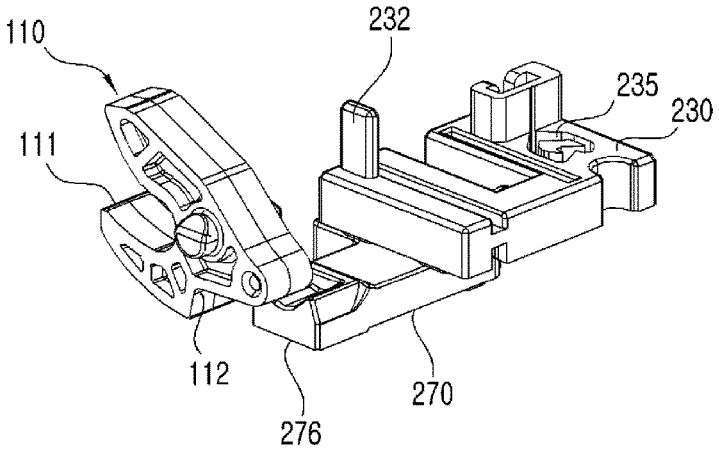
FIG. 5 illustrates a state in which a locker is locked according to an example embodiment.

FIG. 5 illustrates a state in which a locker is locked according to an example embodiment.

Referring to FIGS. 1 to 5, a door lock device according to an example embodiment relates to a door lock device for washing machine that includes a case having an inner space, an opening/closing portion 100 provided in the inner space and configured to open and close a door according to entry and retraction of a hook 30 connected to the door, and a locking portion 200 distinguished from the opening/closing portion 100 and configured to form an independent anterior chamber and to lock or unlock the door. The opening/closing portion 100 includes a locker 110 configured to couple to or separate from the hook 30 through a rotational motion in response to the entry and the retraction of the hook 30 and a cam spring 120 configured to provide a rotational restoring force to the locker 110 through connection to the locker 110. The locking portion 200 includes a solenoid 210 configured to generate a linear thrust by an input electrical signal, a shaft 220 configured to linearly move by the thrust generated from the solenoid 210, a slider 230 configured to linearly move with the shaft 220 through connection to the shaft 220, a fixed cam 235 formed above the slider 230, a cam pin 240 configured to control a linear motion of the slider 230 through connection to one side of the fixed cam 235, an elastic member 250 configured to provide a restoring force to the slider 230, a protrusion 236 formed on a bottom surface of the slider 230, and a locker slide 270 configured to protrude through the linear motion of the slider 230 below the slider 230 and to fasten the locker 110.

Referring to FIG. 1, the door lock device includes the opening/closing portion 100 and the locking portion 200. The opening/closing portion 100 refers to a device that physically locks or unlocks the door in response to entry of the hook 30. Also, the locking portion 200 refers to a device that maintains a locked state of the door or releases the locked state using an electrical energy source.

The opening/closing portion 100 and the locking portion 200 may be integrally coupled and may be separable depending on cases.

The opening/closing portion 100 according to an example embodiment includes the locker 110 and the cam spring 120. The locker 110 refers to a portion to which the hook 30 configured to substantially attach to the door is coupled. The locker 110 is configured to be rotatable at a predetermined angle based on a rotating rod installed on the wall that constitutes an inside of the opening/closing portion 100.

In particular, the locker 110 refers to a portion to which the hook 30 is coupled and that is directly subject to load and thus, may be formed of a metal alloy material or a plastic material that ensures a rigidity as much as possible.

The locker 110 includes a fastening unit 111 configured to insert into a coupling hole formed in the hook 30 and a locker fastening groove 112 in which the locker slide 270 is seated.

The fastening unit 111 refers to a portion to which the hook 30 is coupled and the locker fastening groove 112 is formed in a concave structure in a lower rear portion of the locker 110 such that the locker slide 270 is introduced and prevents rotation of the locker 110.

The cam spring 120 provides the rotational restoring force through connection to the locker 110.

The cam spring 120 is seated in a space formed in the opening/closing portion 100 and is connected to a rear surface of the locker 110.

The cam spring 120 continuously provides an elastic force to the locker 110. In more detail, the cam spring 120 applies an elastic force in a direction of the locker 110 at all times. In the case of configuring the cam spring 120 as above, the locker 110 may be in a closed state at all times or may be in an open state at all times.

That is, the locker 110 may not be in an intermediate state of closing or opening due to the continuous elastic force (repulsion or repulsive force) applied by the cam spring 120. When the elastic force (repulsion or repulsive force) of maintaining the closed state that is a state in which the hook 30 is introduced continuously acts and the locker 110 is in the open state by removing the hook 30 from the locker 110 due to an external force, the locker 110 does not rotate and remains in the open state by the cam spring 120 without another external force being applied.

That is, referring to FIG. 2, the cam spring 120 may have one end coupled to a hole to be formed at the rear of the locker 110 and may be firmly connected to the locker 110. In a state in which the hook 30 is introduced and is coupled to the locker 110, minimum load is applied to the cam spring 120.

Also, when the hook 30 retracts and is removed from the locker 110, the minimum load is applied to the cam spring 120 connected to the locker 110 and the open state is maintained.

The locking portion 200 according to an example embodiment is connected to the opening/closing portion 100 and functions to maintain a locked state to prevent the door from opening during an operation of a home appliance such as a washing machine or a dryer.

As described above, the locking portion 200 includes the solenoid 210, the shaft 220, the slider 230, the fixed cam 235, the cam pin 240, the elastic member 250, the protrusion 236, and the locker slide 270.

The solenoid 210 has a structure in which a magnetic material is mounted and around which a coil is wound. Here, when current is applied to the coil, a magnetic force is formed inside and the magnetic material linearly moves.

The shaft 220 is connected to the solenoid 210 and moves together according to a linear motion generated from the solenoid 210. The shaft 220 may be formed of a metal material and is firmly coupled to the magnetic material of the solenoid 210. In particular, one end of the shaft 220 may be formed to have a wide cross-section and couples with the slider 230 to be described below.

The shaft 220 may be formed of a relatively light material and may not be supported by another structure to not act as a load for the thrust generated from the solenoid 210.

One side of the slider 230 couples with the shaft 220 of the solenoid 210 and another side of the slider 230 couples with the locker slide 270 to be described below. The protrusion 236 is formed on the other surface of the slider 230 and the slider 230 is connected to the locker slide 270.

Also, an induction projection 232 to which a curved electrode terminal 280 is coupled is formed on one side of the slider 230. Also, the fixed cam 235 is formed on one side of the slider 230. The fixed cam 235 is engraved and one end of the cam pin 240 is seated therein, which functions to determine a linear motion play of the slider 230.

The linear motion of the slider 230 by the fixed cam 235 and the cam pin 240 is further described below with reference to FIG. 6.

The cam pin 240 coupled to the fixed cam 235 may be formed of a material having excellent rigidity as a metal pin in a flattened U shape. One end of the cam pin 240 is seated in the fixed cam 235 and another end thereof is fastened in a predetermined external area of the slider 230. The cam pin 240 according to an example embodiment provides a protruding area in the case that houses the slider 230 and the cam pin 240 is coupled by providing a hole for fastening the other end of the cam pin 240 in the protruding area.

The elastic member 250 provides a restoring force to the slider 230 and extends the slider 230 to the right as illustrated in FIG. 1. That is, the elastic member 250 positions the slider 230 in an unlocked state that is a state in which the solenoid 210 does not operate.

Referring to FIG. 4, the protrusion 236 operates the locker slide 270 according to a movement of the slider 230 through coupling to a moving track 275 formed in the locker slide 270.

Operations of the slider 230 and the locker slide 270 are further described with reference to FIG. 6.

The curved electrode terminal 280 couples along the induction projection 232 of the slider 230 and the curved electrode terminal 280 detachably attaches to a ground electrode due to the linear motion of the slider 230.

The locker slide 270 is positioned below the slider 230 and includes the moving track 275 into which the protrusion 236 inserts and configured to connect to the slider 230 and the locker seating groove 276 configured to seat and fasten the locker 110 at one end.

The locker slide 270 may be formed of a plastic material, preferably, the same material as that of the slider 230, and is coupled in a form of a slot to a lower plate of the case in a rectangular shape and free to linearly move.

Referring to FIG. 3, an upper portion of the moving track 275 formed in the locker slide 270 is in a straight shape bent in a direction of the opening/closing portion 100. Referring to FIG. 3, the moving track 275 of the locker slide 270 may be a curved hole formed by passing through the locker slide 270 and may be a curved groove that does not pass through the locker slide 270.

Also, the locker seating groove 276 in which the locker 110 is to be seated is formed at one end of the locker slide 270. The locker seating groove 276 is formed with a size that may protrude outward from the locking portion 200 or insert and may be implemented in a circular groove to be seated in the same shape as that of the locker 110.

Referring to FIG. 5, the locker fastening groove 112 becomes non-rotatable in a state in which the locker fastening groove 112 is seated in the locker seating groove 276. The locker slide 270 is positioned below the slider 230 and moves in a direction different from a moving direction of the slider 230 by the moving track 275 when the slider 230 moves.

Also, the door lock device for washing machine according to an example embodiment further includes an unlock slide 300 formed outside the case and configured to connect to the slider 230.

The unlock slide 300 is formed to protrude outward of the case and may be implemented in a form in which a plastic band is bent in an annular shape as illustrated in FIG. 1 to secure a restoring force by elasticity, but is not necessarily limited thereto.

Components included in the door lock device for washing machine according to an example embodiment is described above in detail.

Hereinafter, an operation state of a door lock device for washing machine according to an example embodiment is described in detail with reference to FIG. 6.

Figure 6:
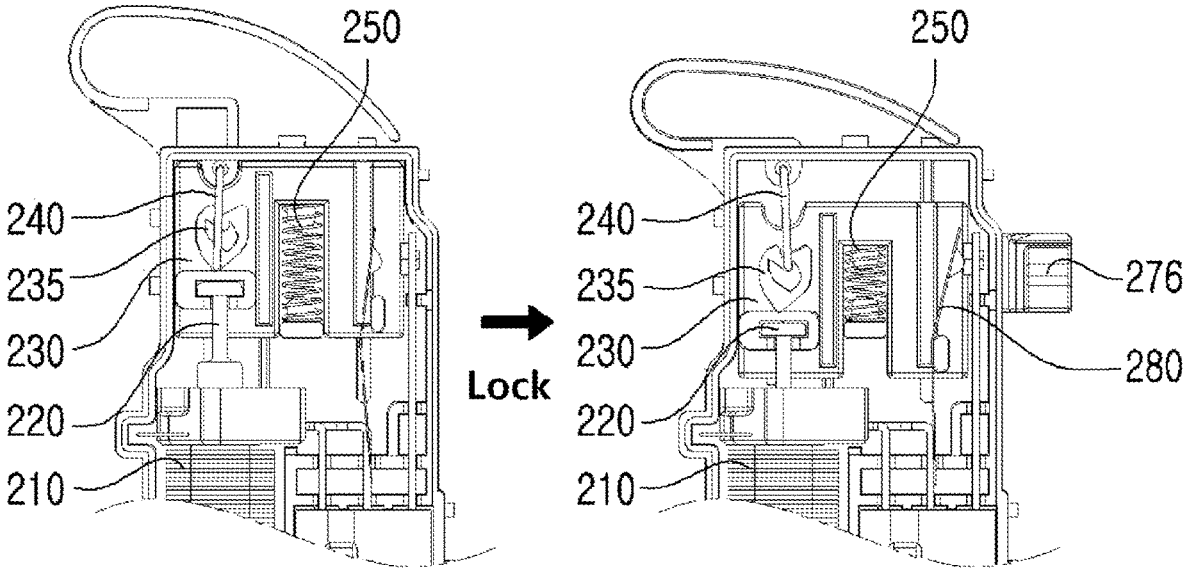
FIG. 6 illustrates an operation state of a locking portion according to an example embodiment.

FIG. 6 illustrates an operation state of a locking portion according to an example embodiment.

A left view of FIG. 6 illustrates the locking portion 200 in a state in which power is not supplied to the solenoid 210. Here, the shaft 220 connected to the solenoid 210 is extended and one end of the cam pin 240 is positioned at a lower end of the fixed cam 235. Also, the elastic member 250 is mounted to the slider 230 in an extended state. Additionally, the curved electrode terminal 280 coupled to the induction projection 232 of the slider 230 is not in contact with the ground terminal.

Therefore, when the locking portion 200 is not operating, the locker seating groove 276 formed at one side end of the locker slide 270 does not protrude to the right of the locking portion 200.

When the locking portion 200 operates as illustrated in the right view of FIG. 6, power is supplied to the solenoid 210 to pull the shaft 220 in a direction of the solenoid 210. The slider 230 connected to the shaft 220 linearly moves in the direction of the solenoid 210 and the cam pin 240 of which one end is located at the lower end of the fixed cam 235 reaches a location at which the cam pin 240 hangs at an upper end of the fixed cam 235. Also, the elastic member 250 mounted to the slider 230 receives a force by the slider 230 in a direction of contraction.

As the slider 230 approaches in the direction of the solenoid 210, the curved electrode terminal 280 is connected to the ground terminal mounted on the side and, as described above with reference to FIG. 3, as the slider 230 descends in the direction of the solenoid 210, the locker slide 270 equipped with the moving track 275 moves to the right and makes the locker seating groove 276 protrude.

Referring to FIG. 5, when the locker seating groove 276 protrudes, the locker seating groove 276 locks the locker 110 through coupling to the locker fastening groove 112 formed at the rear of the locker 110 and the hook 30 introduced to the locker 110 remains fastened to the locker 110. In this manner, the door of the washing machine door is locked.

While the present invention is described with reference to the illustrated example embodiments, it is provided as an example only and it will be apparent to one of ordinary skill in the art that various alterations and modifications in form and details may be made in these example embodiments without departing from the spirit and scope of the claims and their equivalents. For example, suitable results may be achieved if the described techniques are performed in a different order, and/or if components in a described system, architecture, device, or circuit are combined in a different manner, and/or replaced or supplemented by other components or their equivalents. Therefore, the true technical protection scope of the present invention should be determined by the technical spirit of the claims.

What is claimed is:

1. A door lock device for washing machine, the door lock device comprising:

a case having an inner space;

an opening/closing portion provided in the inner space and configured to open and close a door according to entry and retraction of a hook connected to the door; and a locking portion distinguished from the opening/closing portion and configured to form an independent anterior chamber and to lock or unlock the door, wherein the opening/closing portion comprises:

a locker configured to couple to or separate from the hook through a rotational motion in response to the entry and the retraction of the hook; and a cam spring configured to provide a rotational restoring force to the locker through a connection to the locker, and the locking portion comprises:

a solenoid configured to generate a linear thrust by an input electrical signal;

a shaft configured to linearly move by the linear thrust generated from the solenoid;

a slider configured to linearly move with the shaft through a connection to the shaft;

a fixed cam formed in a top surface of the slider;

a cam pin configured to control a linear motion of the slider through a connection to one side of the fixed cam;

an elastic member configured to provide a restoring force to the slider;

a protrusion formed on a bottom surface of the slider; and a locker slide positioned below the slider, wherein the locker slide comprises:

a moving track in which the protrusion is located, wherein the moving track is formed in the locker slide and has a first portion, which extends in parallel with a longitudinal direction of the elastic member, and a second portion, which extends in a direction inclined toward the opening/closing portion, wherein the second portion has a first distal end, which is connected with the first portion, and a second distal end, which is positioned closer to the opening/closing portion than the first distal end; and a locker seating groove positioned at one end of the locker slide and configured to seat and fasten the locker, and wherein the linear motion of the slide causes the locker slide to move in a direction different from the linear motion of the slider through an engagement of the protrusion with a shape of the second portion of the moving track, so as to fasten the locker.

2. The door lock device of claim 1, wherein the locker comprises:

a fastening unit configured to insert into a coupling hole formed in the hook; and a locker fastening groove in which the locker slide is seated when the locker slide fastens the locker.

3. The door lock device of claim 1, wherein an induction projection is formed on the slider, and an electrode terminal is bent at an angle and coupled to the induction projection.

4. The door lock device of claim 1, further comprising:

an unlock slide formed on an outside of the case and configured to connect to the slider.

* * * * *